US006364755B1

(12) United States Patent
Sweek

(10) Patent No.: US 6,364,755 B1
(45) Date of Patent: Apr. 2, 2002

(54) BELT SANDER CONVERSION SYSTEM AND METHOD

(76) Inventor: Ernest J. Sweek, 35 Robinwood Dr., Brownsburg, IN (US) 46112

( * ) Notice: Subject to any disclaimer, the term of this patent is extended or adjusted under 35 U.S.C. 154(b) by 0 days.

(21) Appl. No.: 09/551,485

(22) Filed: Apr. 18, 2000

(51) Int. Cl.[7] ..... B24B 23/06

(52) U.S. Cl. ..... 451/355; 451/350; 15/99; 280/47.34

(58) Field of Search ..... 451/350–356, 451/355, 354; 15/99, 51; 280/47.34

(56) References Cited

U.S. PATENT DOCUMENTS 2,205,492 A * 6/1940 Reid ..... 451/350
4,727,686 A * 3/1988 Persson ..... 451/350

FOREIGN PATENT DOCUMENTS

DE 003037201 A1 * 4/1982 ..... 451/355
DE 3342480 A1 * 6/1985 ..... 451/353
DE 391651 A1 * 12/1990 ..... 451/355

* cited by examiner

*Primary Examiner*—George Nguyen
(74) *Attorney, Agent, or Firm*—Daniel J. O'Connor

(57) ABSTRACT

A system and method for converting a conventional hand-held belt sander tool to a walk-behind unit. The design reduces labor for floor sanding operations while utilizing an economical sander tool. The conversion system includes dual handle elements and a variable ballast or weight system to account for differing sanding requirements. A remote operating power switch and stabilizing bars are also included in the overall system.

1 Claim, 1 Drawing Sheet

BELT SANDER CONVERSION SYSTEM AND METHOD

BACKGROUND AND OBJECTS OF THE INVENTION

The present invention is generally related to the belt sander arts and, in particular, to a novel system and method for efficiently converting a hand-held belt sander into a walk-behind unit.

Hand-held belt sanders are used to sand rough edges on wood flooring products such as plywood or strand board. For flooring operations, the workman must operate on hands and knees in close proximity to the dust created by the sanding operation.

Accordingly, it is an object of the present invention to convert a conventional hand-held sander to a walk-behind unit by the addition of a unique extension handle and ballast system.

It is a further object of the invention to demonstrate a conversion system wherein an extended handle may be easily attached to or detached from a conventional belt sander.

It is an object of the invention to set forth a unique ballast or weight system which is variable depending upon the particular light or heavy sanding job required. The ballast system also enables the light weight hand-held unit to be converted to an efficient walk-behind unit.

It is still further object of the invention to show an extension handle which may be economically mass-produced for widespread commercial appeal.

These and other objects and advantages of the present invention will be apparent to those of skill in the art from the description which follows.

PRIOR ART PATENTS AND DESIGNS

U.S. Pat. No. 5,074,081 teaches the use of a removable short auxiliary handle 20 to improve efficiency for some hand-held operations. It does not provide for a walk-behind unit nor include the ballast or weight system of the present invention.

U.S. Pat. No. 5,558,570 teaches the use of a short detachable handle 21 for use with a power tool such as a sander. The patent does not teach the elongated handle, stabilizing bars or the ballast system of the present invention to enable conversion of a hand-held sander to a walk-behind unit.

The present invention is thus believed to be clearly patentable over all known prior art systems.

SUMMARY OF THE INVENTION

A dual handle system of approximately four to five feet in length is attached to the front end of a conventional belt sander.

The dual handles include lower angled attaching ends and upper angled handle means.

A variable weight or ballast is attached to the handles in a position over the belt sander to achieve variable sanding pressure depending upon the particular sanding work being undertaken.

A remote switch element is placed on an upper end of one of the handles to enable activation of the belt sander power switch.

Stabilizing bars are placed between the handle elements to secure the handles and the overall unit.

BRIEF DESCRIPTION OF THE DRAWING FIGURES

DESCRIPTION OF A PREFERRED EMBODIMENT

Figure 1:
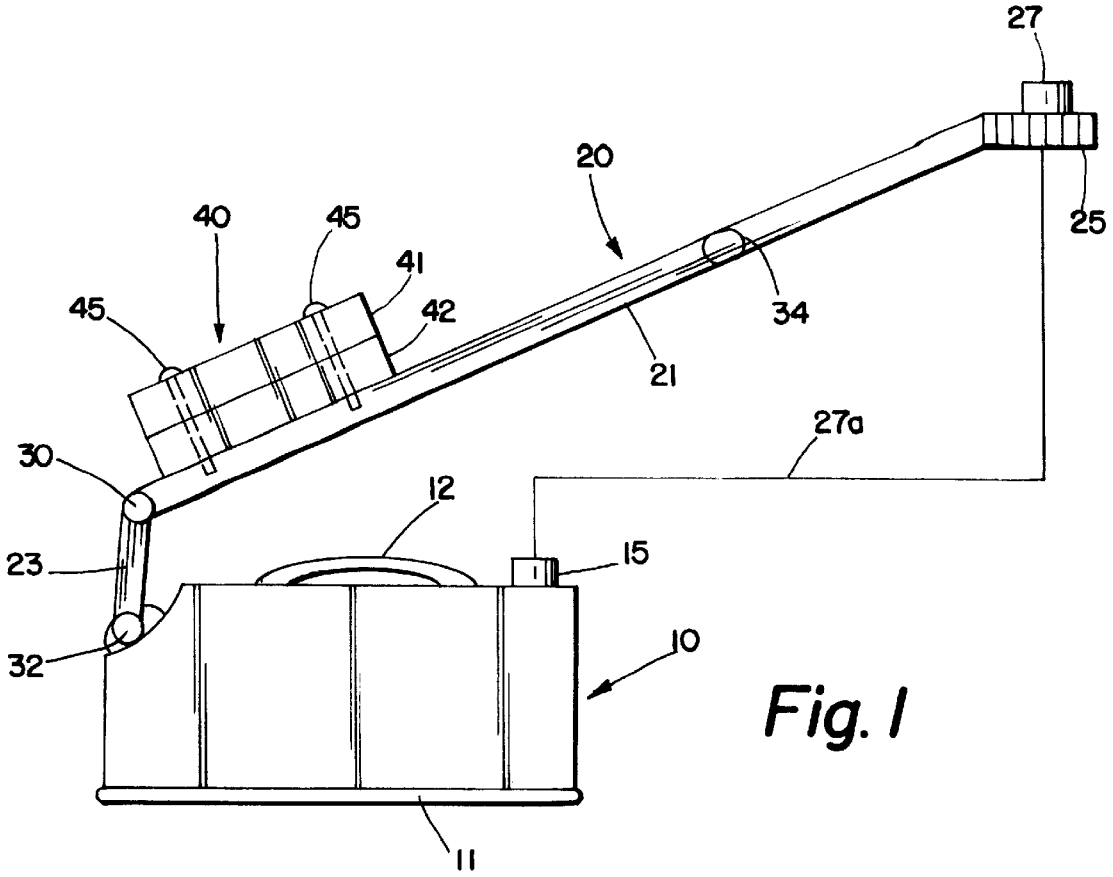
FIG. 1 shows a side schematic view of a conventional hand-held sander and the principle elements of the invention to enable the efficient conversion of the sander to a walk-behind unit.

Referring to the drawing FIG. 1, a conventional hand-held sander unit 10 is shown as having a handle 12 and a power switch 15. A lower belt sander element is indicated at numeral 11.

The use of such hand-held sanders for needed floor sanding uses is very labor intensive since the user must operate on hands and knees.

In accord with the present invention, an elongated handle means 20 is added to the unit. The handle means 20 includes dual handles 21 and 22 as indicated in FIG. 2.

Referring again to FIG. 1, handle 21 is shown as having a lower, downwardly angled portion 23 the end of which is attached to the front of sander 10. Handle 21 also has an upper angled portion 25 for grasping by the user as will be further explained.

Figure 2:
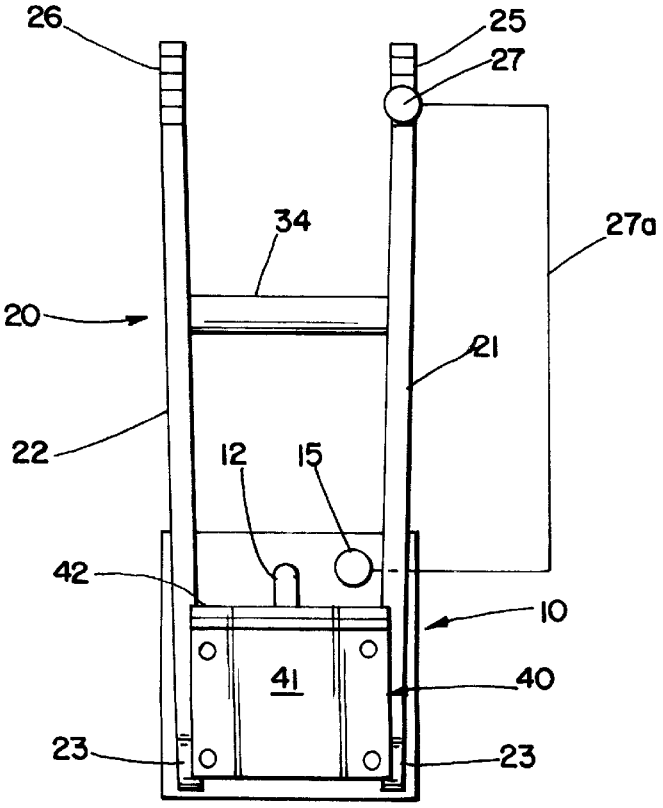
FIG. 2 shows a top schematic view of the combined unit illustrating the location of dual handles 21 and 22, the stabilizing bar means and position of the weight or ballast elements.

Handle 22, shown in FIG. 2, has the same structure as handle 21.

Handles 21 and 22 are attached to the front end of the sander 10 via bolt and nut or wingnut elements as indicated schematically at numeral 32.

The ballast or weight system is indicated generally at numeral 40 and is mounted to the dual handles 21 and 22 in a position over the sander 10.

The ballast system 40 comprises two steel plates 41 and 42 which are attached to the handles 21 and 22 by, for example, bolt elements 45.

Each of the steel plates 41 and 42 weigh approximately 8.5 pounds and provide a downward force or ballast to efficiently control the relatively light weight sander 10.

For lighter sanding jobs, a single steel ballast plate 42 may be utilized to effectively weigh down the sander 10.

When a higher degree of sanding force is required for a particular job, a second steel plate ballast 41 may be easily added to the system.

Stabilizer bars comprising bolt and nut or wingnut elements extend between the handles 21 and 22 and are indicated schematically at numerals 30 and 34.

In order to provide efficient operator control, a power switch 27 may be provided at one of the upper handle elements 25 or 26. A power line 27*a* controls the on-off power switch 15 on the conventional sander unit 10.

The materials suggested for the handle elements are heavy gauge steel tubing. Rubber handle grips may be utilized on the upper ends of the handles at 25 and 26.

In practice of the invention, a conventional belt sander may thus be adapted for multi-purposes, i.e., used in a normal fashion for table-top uses or easily converted by addition of the handle means 20 to a sander which may be efficiently used for floor sanding purposes.

The invention would thus be useful for builders or other craftsmen in the mechanical arts.

The invention saves time in the sanding process and reduces labor expenditure for the user.

While a particular embodiment has been shown and described, it is intended in this specification to broadly cover all equivalent structures and methods which would reasonably occur to those of skill in the art.

The invention is further defined by the claims appended hereto.

I claim:

1. In combination:

a conventional belt sander(10) having a front end and a rear end, said rear end having a power switch(15) located thereon, said sander having a removable handle(20) attached to the front end thereof, said removable handle(20) comprising two arms(21,22) wherein each of said arms has a downwardly turned end(23) for attachment to the front end of said sander(10), a pair of weight plates(41,42) attached to a lower end of said handle(20) so as to be positioned directly over said belt sander(10), said weight plates(41,42) being attached between said arms(21,22) via bolt elements(45), wherein said handle(20) is attached to the front end of said belt sander by removable wingnut elements(32), said belt sander further including an operating power switch(15) located on the rear end thereof and wherein said combination further includes a remote switch(27) attached to said removable handle(20) and an electric line(27*a*) extending between said power switch(15) and said remote switch(27), wherein said belt sander(10) is devoid of wheels or rollers on a lower end thereof, wherein said weight plates(41,42) weigh approximately eight and one-half pounds each to provide a substantial downward force for the combined unit, wherein said handle(20) includes a stabilizer bar(30) which is located between the lower ends of arms(21,22) and the downwardly turned end(23) which is attached to the front end of the sander(10), the combination providing for easy conversion of the sander from a hand-held to a walk-behind unit.

* * * * *